US009409385B2

(12) United States Patent
Ahler et al.

(10) Patent No.: US 9,409,385 B2
(45) Date of Patent: Aug. 9, 2016

(54) INTERMEDIATE SLEEVE

(75) Inventors: Herbert Ahler, Vreden (DE); Helmut Gruber, Ahaus-Ottenstein (DE); Christian Schnieders, Velen (DE); Michael Kockentledt, Legden (DE)

(73) Assignee: Day International, Inc., Dayton, OH (US)

( * ) Notice: Subject to any disclaimer, the term of this patent is extended or adjusted under 35 U.S.C. 154(b) by 2134 days.

(21) Appl. No.: 11/744,946

(22) Filed: May 7, 2007

(65) Prior Publication Data

US 2007/0256583 A1 Nov. 8, 2007

Related U.S. Application Data

(60) Provisional application No. 60/798,495, filed on May 8, 2006.

(51) Int. Cl.
*B41F 27/14* (2006.01)
*B41N 6/00* (2006.01)

(52) U.S. Cl.
CPC .. *B41F 27/14* (2013.01); *B41N 6/00* (2013.01)

(58) Field of Classification Search
CPC ..... B41F 27/14; B41F 13/10; B41N 6/00; B41N 27/14
USPC ..... 101/375, 376, 383, 389.1, 217
See application file for complete search history.

(56) References Cited

U.S. PATENT DOCUMENTS

| | | | | |
|---|---|---|---|---|
| 5,782,181 | A | 7/1998 | Rossini | |
| 5,819,657 | A | 10/1998 | Rossini | |
| 5,904,095 | A | 5/1999 | Nelson | |
| 6,223,655 | B1 * | 5/2001 | Shanbaum et al. | 101/395 |
| 6,467,409 | B2 * | 10/2002 | Busshoff | 101/375 |
| 6,782,821 | B2 | 8/2004 | Dilling et al. | |
| 6,799,510 | B2 | 10/2004 | Sandstrom | |
| 2003/0012945 | A1 * | 1/2003 | Runge et al. | 428/317.1 |
| 2003/0217661 | A1 * | 11/2003 | Schnieders | 101/376 |
| 2007/0144381 | A1 | 6/2007 | Lorig et al. | |

FOREIGN PATENT DOCUMENTS

| | | | |
|---|---|---|---|
| DE | 20 2004 004 375 | U1 | 10/2004 |
| WO | 01070505 | A2 | 9/2001 |
| WO | 2004018210 | A1 | 3/2004 |

* cited by examiner

*Primary Examiner* — Jennifer Simmons
(74) *Attorney, Agent, or Firm* — Dinsmore & Shohl LLP

(57) ABSTRACT

An intermediate sleeve is provided which is adapted to be mounted on a print cylinder. The intermediate sleeve includes a base layer, a reinforcing layer, a barrier layer, and a surface layer. The sleeve further includes at least one air channel extending longitudinally, circumferentially, or spirally along the interior of the sleeve, at least one air passageway extending from an inner surface of the sleeve into the air channel, and a plurality of orifices extending radially outward from the air channel to an outer surface of the sleeve. The air channel, air passageway, and orifices are in communication such that pressurized air can be supplied from the interior of the print cylinder to the outer surface of the sleeve for mounting a printing sleeve on the intermediate sleeve.

12 Claims, 1 Drawing Sheet

INTERMEDIATE SLEEVE

CROSS REFERENCE TO RELATED APPLICATIONS

This application claims the benefit of U.S. Provisional Application No. 60/798,495 entitled INTERMEDIATE SLEEVE filed May 8, 2006. The entire contents of said application are hereby incorporated by reference.

BACKGROUND OF THE INVENTION

The present invention relates to an intermediate sleeve which is adapted for use in flexographic, offset or gravure printing systems, and more particularly, to an intermediate sleeve including air channels and orifices therein which allow pressurized air to be supplied from a printing cylinder for the mounting and dismounting of printing sleeves.

In a typical flexographic printing process, a flexographic printing plate is attached to a printing cylinder, and as the cylinder rotates, the inked plate provides an image onto a substrate carried on an impression drum. It is conventional in the art to provide the printing plate in the form of a printing sleeve which is expandable by air pressure for mounting and demounting onto the print cylinder.

As is also known in the art, the diameter of the inner surface of an air-mounted printing sleeve must be slightly smaller than the diameter of the outer surface of the printing cylinder. However, depending on the type of print job performed, the sleeve may require a larger outer diameter while still maintaining a small inner diameter for fitting onto the printing cylinder. Multi-layer sleeves have been developed which provide a larger outer diameter and a small inner diameter. However, such multilayer sleeves are more expensive to manufacture than thin sleeves.

An alternative solution to the use of multi-layer sleeves has been the use of an intermediate or bridge sleeve, also referred to as a bridge mandrel, which can be used in combination with a thin printing sleeve, i.e., the thin sleeve is mounted on the intermediate sleeve with the use of pressurized air. Such intermediate sleeves must be able to deliver pressurized air to the outer surface of the sleeve to facilitate mounting and dismounting of the thin printing sleeve. One example of an intermediate sleeve is described in commonly-assigned U.S. Pat. No. 6,467,409, which teaches a bridge mandrel in the form of a cylindrically shaped tube including a channel extending around the circumference of the inner surface of the tube and including air holes or orifices extending radially outward from the channel to the outer surface of the tube. The channel and air holes permit pressurized air to be provided from the interior of the mandrel to its outer surface for mounting a printing sleeve to the mandrel. However, the design of the bridge mandrel restricts air conduction to those areas directly above the air exit holes.

Another known bridge sleeve manufactured under the designation Airo Light® is provided with an internal air conduction system which allows air to be delivered to predetermined outlet holes on the sleeve surface. The system comprises hoses which are embedded into the sleeve circumferentially and longitudinally and which are fixed by encapsulation with a cast polymer resin. Such hoses act as channels which receive pressurized air from a compressed air source and deliver it to the outlet holes. However, the use of such embedded hoses requires a greater minimum wall thickness for the sleeve. In addition, it is not possible to provide such longitudinal hoses in some types of intermediate sleeves.

Accordingly, there is still a need in the art for an improved intermediate sleeve for use in flexographic printing applications which facilitates the mounting of printing sleeves with the use of pressurized air but which does not suffer from the drawbacks of prior sleeves.

SUMMARY OF THE INVENTION

The present invention meets that need by providing an intermediate sleeve for use in flexographic printing applications which includes a versatile air conduction system in which air exit holes may be provided easily in any desired location along one or more air channels provided within the sleeve. The sleeve has a reduced wall thickness in comparison with previous bridge sleeves, and does not require the use of embedded hoses, which allows the intermediate sleeve to be used with all types of printing sleeves.

According to one aspect of the present invention, an intermediate sleeve is provided which is adapted to be mounted on a print cylinder. The sleeve comprises a cylindrical tube having an inner surface, an outer surface, and first and second ends, and includes a base layer, a reinforcing layer over the base layer, a barrier layer over the reinforcing layer, and a surface layer. The sleeve further includes at least one air channel extending longitudinally, circumferentially or spirally along the interior of said sleeve, and at least one air passageway extending from the inner surface of the sleeve into the air channel; where the air channel is in communication with the air passageway.

In a preferred embodiment, the sleeve preferably includes at least two air channels and at least two air passageways therein.

The sleeve preferably further includes a plurality of orifices which extend radially outwardly from the air channel to the outer surface of the sleeve. The orifices preferably extend through the barrier layer and surface layer, and are preferably provided at intervals along the length of the air channels.

The base layer of the intermediate sleeve preferably comprises a metal or a polymer. The polymer may comprise a rigid polymer, or it may comprise a fiber-reinforced polymer.

The polymeric reinforcement layer preferably comprises a foamed or filled polyurethane. The polymeric reinforcement layer preferably includes an upper surface and a lower surface, where a portion of the upper surface has been removed to form the air channel. The barrier layer may comprise an adhesive tape or a fiber-reinforced polymer material and overlies the polymeric reinforcement layer such that it comprises the upper wall of the air channel.

Preferably, the polymeric reinforcement layer includes at least two air channels formed therein. The air channel(s) preferably have a depth of between about 0.5 to 5 mm and a width of from between about 3 to 20 mm.

The surface layer preferably comprises a polymer such as polyurethane.

In use, the intermediate sleeve is mounted on a print cylinder, and the air channel(s), air passageway(s), and orifices are in communication such that pressurized air can be supplied from the interior of the print cylinder to the outer surface of the intermediate sleeve for mounting a printing sleeve thereto, i.e., the air passageway provides a path for pressurized air supplied from the print cylinder to enter the air passageway, the air channel(s) and then exit through the orifices at the surface of the intermediate sleeve to radially expand the inner surface of the print sleeve. Once a printing job has been completed, the print sleeve may be easily removed by the use of pressurized air.

Accordingly, it is a feature of the present invention to provide an intermediate sleeve including at least one air channel in combination with a plurality of orifices which allow pressurized air to be provided for the mounting and dismounting of a printing sleeve. Other features and advantages of the invention will be apparent from the following description, the accompanying drawings, and the appended claims.

DETAILED DESCRIPTION OF THE PREFERRED EMBODIMENTS

The intermediate sleeve of the present invention is simple to manufacture and easy to mount and dismount from an underlying print cylinder in flexographic, offset, and gravure printing systems. The design of the sleeve offers several advantages over prior bridge sleeves in that the air channels are provided without requiring the use of special air hoses which must be oriented and embedded in the sleeve. The elimination of such hoses allows the wall thickness of the sleeve to be minimized. In addition, because the air channels are typically formed longitudinally along the length of the sleeve, orifices may be provided at any desired location on the sleeve along the length of the channels. This permits the intermediate sleeve to be compatible with all types of print cylinders and printing sleeves.

The fiber-reinforced polymeric materials used to form the barrier layer in the sleeve construction are also beneficial as they have coefficients of thermal expansion which minimize changes in diameter to the sleeve which could otherwise occur due to processing temperatures encountered during fabrication of the sleeve and during the printing process, and thus provide protection against undesired deformation of the sleeve.

Figure 1:
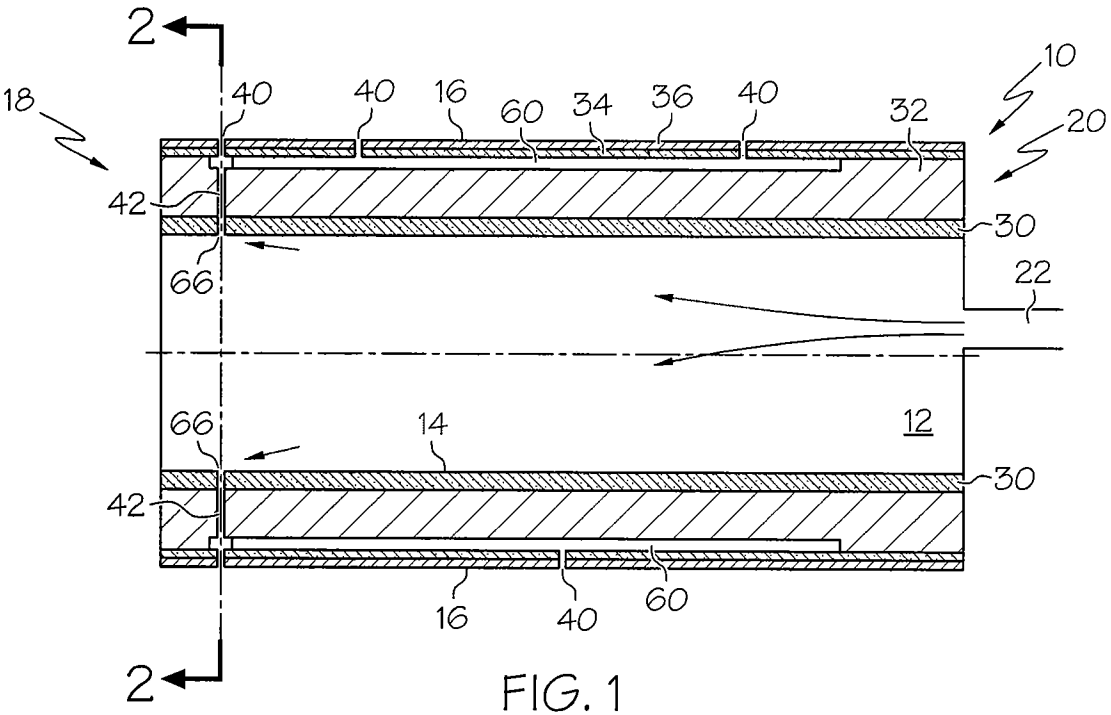
FIG. 1 is a side view in section of an assembly of one embodiment of the intermediate sleeve of the present invention mounted onto a printing cylinder, with a printing sleeve mounted on the intermediate sleeve.

Referring now to FIG. 1, an embodiment of the intermediate sleeve is illustrated in which intermediate sleeve 10 is mounted onto a print cylinder 12. Intermediate sleeve 10 is generally in the shape of a hollow, cylindrically shaped tube having an inner surface 14, and outer surface 16, and first and second ends 18 and 20, respectively.

Print cylinder 12 is mounted for rotation about its longitudinal axis, and in use, would be part of a printing press or other print system (not shown). An air inlet 22 is provided which supplies air under pressure into the interior of the print cylinder from a source (not shown).

As shown in FIG. 1, the inner diameter of sleeve 10 and the outer diameter of cylinder 12 are matched such that there is a close interference fit. The assembly may be linked together by means of a conventional locking mechanism (not shown).

Figure 2:
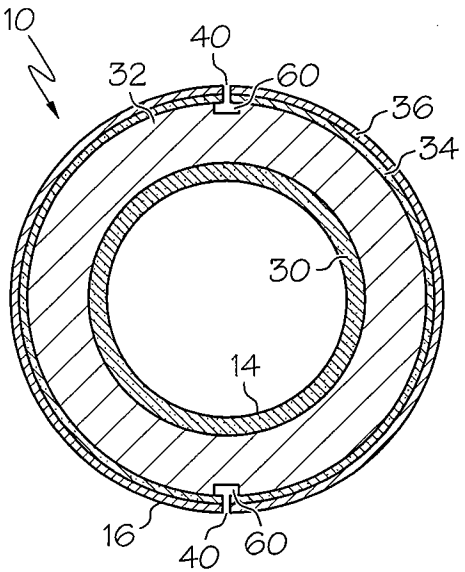
FIG. 2 is a cross-sectional view of the intermediate sleeve taken along line 2-2 in FIG. 1 illustrating the channels therein.

As shown in FIGS. 1 and 2, the intermediate sleeve 10 comprises a base layer 30, a polymeric reinforcement layer 32, a barrier layer 34, and an outer surface layer 36. The base layer 30 preferably comprises a fiber-reinforced polymeric material. The polymeric reinforcement layer 32 preferably comprises a foamed polyurethane.

As shown in FIG. 1, a portion of the upper surface of the polymeric reinforcement layer 32 has been removed so as to form air channels 60 which preferably extend longitudinally along the length of the sleeve. Alternatively, air channels 60 may be formed so that they extend circumferentially or laterally around the sleeve. The portion of the polymeric reinforcement layer is preferably removed by machining.

After the air channels 60 are formed in the polymeric reinforcement layer 32, a barrier layer 34 is preferably applied over the reinforcement layer 32 to form an upper wall for the air channels. Barrier layer 34 may comprise an adhesive tape. Preferably, the barrier layer comprises a fiber-reinforced polymeric material which is wound around the surface of the sleeve by conventional winding techniques.

As shown in FIG. 1, the intermediate sleeve 10 is also provided with one or more orifices or air holes 40 which extend outwardly from the air channels to the outer surface of the sleeve. The orifices 40 are preferably spaced at intervals along the length of the air channels and are in communication with the air channels to allow pressurized air to be released onto the surface of the sleeve.

The intermediate sleeve further includes air passageways 42 which extend from the inner base layer 30 to the air channels 60 in the polymeric reinforcement layer 32 to provide a path for pressurized air supplied from within the print cylinder to the air channels 60 and orifices 40.

Mounting of a printing sleeve (not shown) over the intermediate sleeve 10 may be accomplished by supplying air under pressure to the interior of printing cylinder 12. Printing cylinder 12 is equipped with a plurality of air passageways 66 which provide a path to air passageways 42 and air channels 60 in the intermediate sleeve as shown in FIG. 1. Pressurized air flows through passageways 66, 42, and into air channels 60. From channels 60, the air flows through the plurality of orifices 40 to the outer surface 16 of the sleeve. There, the pressurized air acts to expand the inner diameter of a print sleeve slightly, enough to permit the print sleeve to slide easily along the length of the intermediate sleeve until it is completely mounted. Once the air pressure is removed, the print sleeve contracts to form a tight friction fit with the intermediate sleeve.

As there is often a need for print jobs having varying lengths, the intermediate sleeve 10 is designed to be readily mounted and dismounted from print cylinder 12. As new jobs are processed, intermediate sleeves having different outer diameters, but common inner diameters, may be exchanged by the press operator to provide the correct outer diameter for the desired print job. The intermediate sleeve of the present invention may be manufactured in many sizes and outer diameters to accommodate a variety of different image repeats as is common in the industry.

Having described the invention in detail and by reference to preferred embodiments thereof, it will be apparent that modifications and variations are possible without departing from the scope of the invention.

What is claimed is:

1. An intermediate sleeve adapted to be mounted on a print cylinder; said sleeve comprising a generally cylindrical tube having an inner surface, an outer surface, and first and second ends; said sleeve including a base layer, a polymeric reinforcing layer over said base layer including an upper surface and a lower surface, a barrier layer over said reinforcing layer, and a surface layer; said sleeve further including at least one air channel along the longitudinal length of the interior of said sleeve formed by removal of a portion of said upper surface of said reinforcing layer with said barrier layer forming an upper wall for said at least one air channel, at least one air passageway extending from said inner surface into said air channel such that said at least one air channel is in communication with said at least one air passageway, and a plurality of orifices extending radially outward from said at least one air channel to said outer surface of said sleeve, wherein said orifices are provided at intervals along the longitudinal length of said sleeve.

2. The intermediate sleeve of claim 1 wherein said orifices extend through said barrier layer and said surface layer.

3. The intermediate sleeve of claim 1 including at least two air channels therein.

4. The intermediate sleeve of claim 1 including at least two air passageways therein.

5. The intermediate sleeve of claim 1 wherein said reinforcement layer comprises a foamed polyurethane.

6. The intermediate sleeve of claim 1 wherein said reinforcement layer includes at least two air channels formed therein.

7. The intermediate sleeve of claim 1 wherein said barrier layer is selected from an adhesive tape or a fiber-reinforced polymer.

8. The intermediate sleeve of claim 1 wherein said barrier layer comprises an upper wall of said at least one air channel.

9. The intermediate sleeve of claim 1 wherein said surface layer comprises polyurethane.

10. The intermediate sleeve of claim 1 wherein said at least one air channel has a depth of between about 0.5 to 5 mm.

11. The intermediate sleeve of claim 1 wherein said at least one air channel has a width of from between about 3 to 20 mm.

12. In combination, an intermediate sleeve mounted on a print cylinder, said sleeve having an inner surface, an outer surface, and first and second ends; and comprising a base layer, a reinforcing layer including an upper surface and a lower surface, a barrier layer, and a surface layer; said sleeve further including at least one air channel extending along the longitudinal length of the interior of said sleeve formed by removal of a portion of said upper surface of said reinforcing layer with said barrier layer forming an upper wall for said at least one air channel, at least one air passageway extending from said inner surface of said sleeve into said air channel; and a plurality of orifices extending radially outwardly from said at least one air channel to said outer surface of said sleeve, wherein said orifices are provided at intervals along the longitudinal length of said sleeve; said air channel, air passageway and orifices being in communication such that pressurized air can be supplied from the interior of said print cylinder to said outer surface of said sleeve for mounting a printing sleeve thereto.

* * * * *